United States Patent [19]

Wildhaber

[11] 4,003,681

[45] Jan. 18, 1977

[54] POSITIVE-DISPLACEMENT UNIT WITH COAXIAL ROTORS

[76] Inventor: Ernest Wildhaber, 124 Summit Drive, Rochester, N.Y. 14620

[22] Filed: Feb. 20, 1975

[21] Appl. No.: 551,102

[52] U.S. Cl. ..... 418/36; 74/393; 74/437; 74/609

[51] Int. Cl.[2] ..... F01C 1/00; F04C 17/00; F16H 35/02; F16H 55/04

[58] Field of Search ..... 418/36, 37; 74/437, 74/393, 431, 432, 609, 439; 123/8.47

[56] References Cited

UNITED STATES PATENTS

| | | | |
|---|---|---|---|
| 244,290 | 7/1881 | Pennington | 74/414 |
| 1,298,838 | 4/1919 | Weed | 123/8.47 |
| 1,485,591 | 3/1924 | Bullington | 418/37 |
| 2,108,385 | 2/1938 | Murakami | 418/36 |
| 3,256,866 | 6/1966 | Bauer | 418/36 |
| 3,398,643 | 8/1968 | Schudt | 418/36 |
| 3,430,573 | 3/1969 | Groeger | 418/36 |
| 3,769,946 | 11/1973 | Scherrer | 418/36 |

FOREIGN PATENTS OR APPLICATIONS

| | | | |
|---|---|---|---|
| 557,751 | 5/1923 | France | 418/36 |
| 669,498 | 12/1938 | Germany | 418/36 |
| 1,122,549 | 12/1962 | Germany | 418/36 |

OTHER PUBLICATIONS

Pesqueira, J. J., *Principles of Design for Non-Circular Gears*, in Product Engineering, Dec. 1936, pp. 454–457.

*Primary Examiner*—John J. Vrablik

[57] ABSTRACT

Two coaxial rotors are connected with a counter-shaft through two pairs of varying-motion gears of opposite phase. The two gears of each pair differ from each other to provide perfect mass-balance and improved accuracy. Tooth ratios of 1:2 and 1:1 are used. The gear pitch-surfaces that roll on each other without slippage intersect the circular pitch surfaces of uniform-motion gears of the same tooth ratio and center distance and on the gear rigid with a rotor they extend further out from said circular pitch surface than on the mating gear. The tooth shape is such that on uniform rotation of the counter-shaft the rotor has a uniform rotation plus an added harmonic motion.

The invention also provides a simplified production as a result of the novel tooth shape.

10 Claims, 13 Drawing Figures

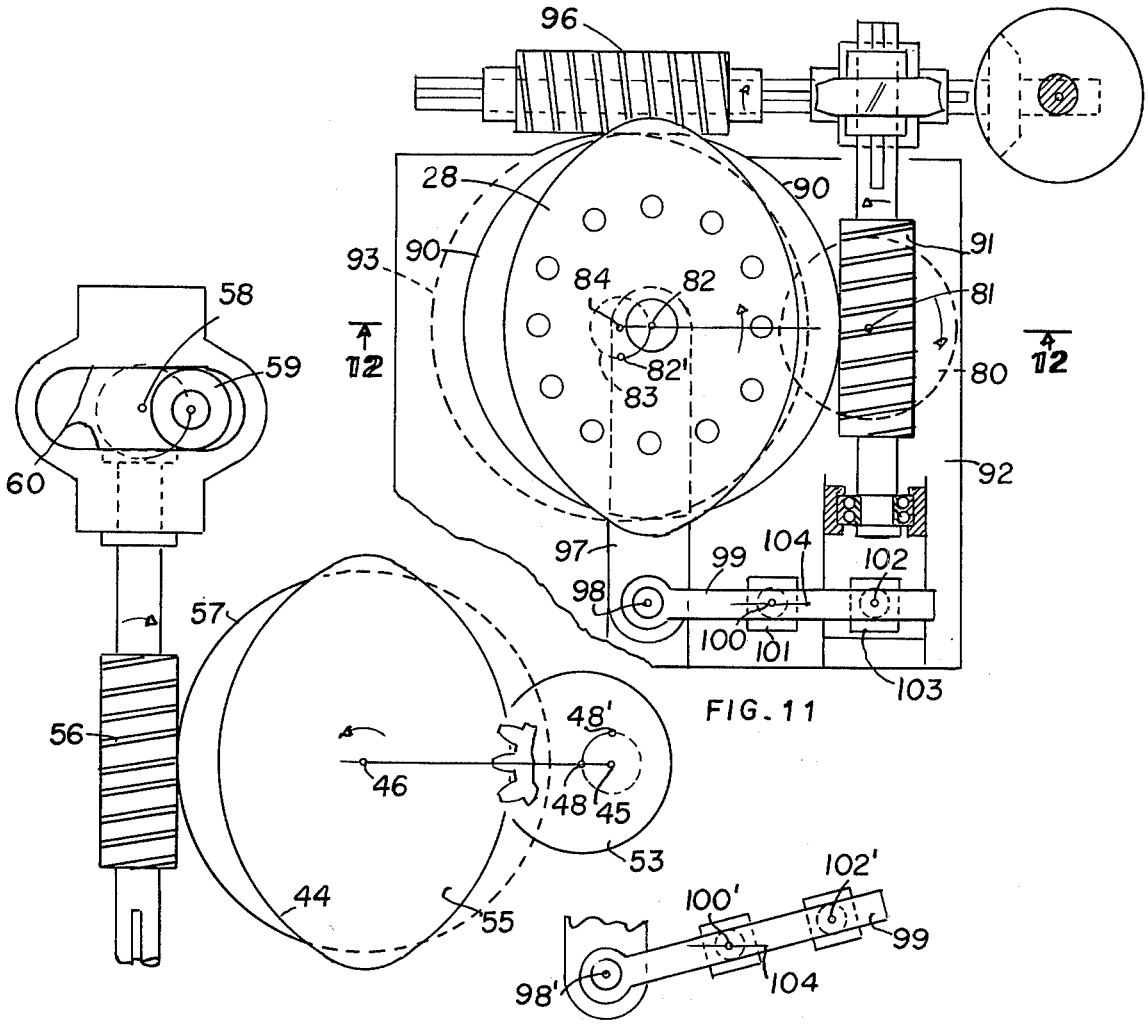
FIG. 11
FIG. 10
FIG. 11a
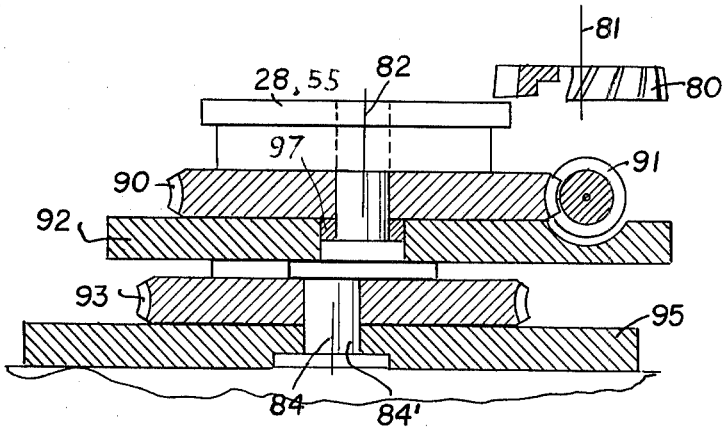
FIG. 12

POSITIVE-DISPLACEMENT UNIT WITH COAXIAL ROTORS

The invention applies to compressors, pumps, engines and generally to positive-displacement units. It contains two coaxial rotors in opposite phase. Each rotor contains a pair of arms projecting outwardly from its shaft inside of a housing. In operation the arms or projections of the rotors include varying volumes with each other acting on the air of fluid used. A counter-shaft extends preferably parallel to the axis of the rotors. It is connected with the two rotors through two pairs of varying-motion gears of opposite phase. These gear pairs providing full mass-balance, and their simplified production, are the chief novel features of the invention.

Prior art shows varying-motion gear pairs wherein both gears are identical and produce unbalanced inertia couples.

Reference is also made to my prior U.S. Pat. No. 2,503,894.

The invention will be described in connection with the accompanying drawings, in which FIG. 1 is a section laid through the rotor axis and the axis of the offset counter-shaft of an engine constructed according to the present invention.

FIG. 10 is a diagrammatic view illustrating a way of producing gear 28 of FIG. 7, when the mate 27 contains straight teeth parallel to its axis. The view is taken along the gear axis.

FIG. 11 is a similar view applying also when said mate contains helical teeth. FIG. 11*a* is an explanatory diagram.

FIG. 12 is a section taken along lines 12—12 of FIG. 11.

Figure 2:
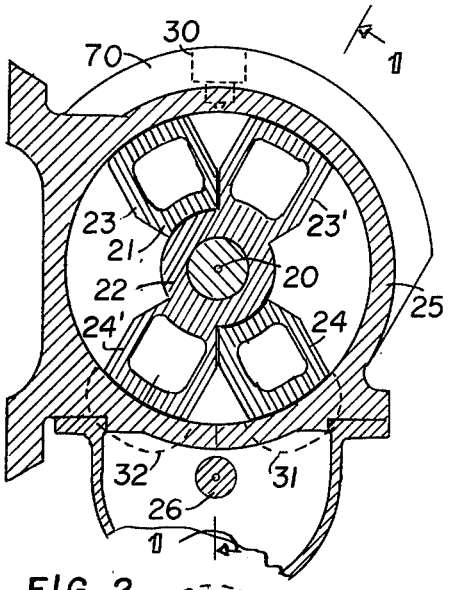
FIG. 2 is a cross-section taken along lines 2 — 2 of FIG. 1, looking along said axes.
Figure 1:
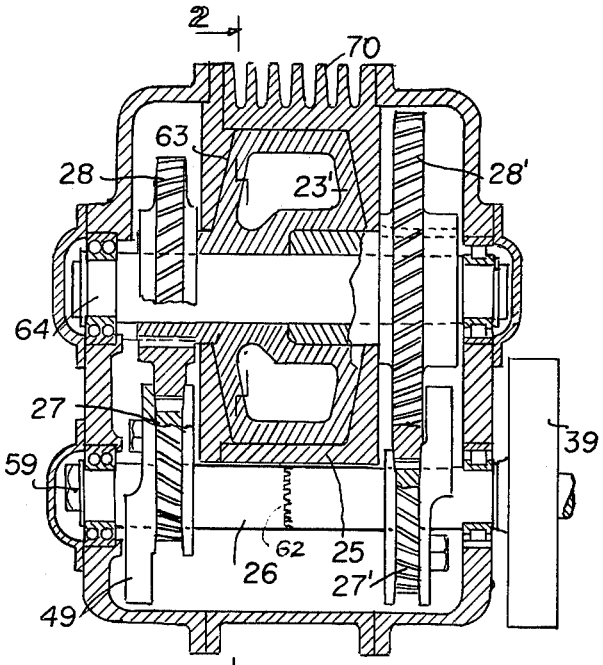
Figure 3:
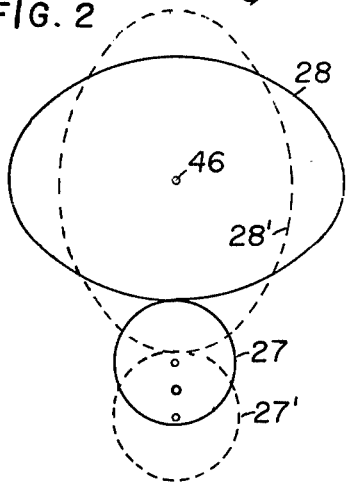
FIG. 3 is a diagram corresponding to FIG. 2 showing the approximate pitch lines of the two varying-motion gear pairs that connect the counter-shaft with the two rotors.

In FIGS. 1 to 3 numeral 20 denotes the common axis of the rotors 21, 22. The rotors contain each a pair of arms or blades 23, 24 and 23′, 24′, that project outwardly from axis 20 inside of a housing 25 with cylindrical inside surface. The two rotors are geared to an offset shaft or counter-shaft 26 by two pairs 27, 28 and 27′, 28′ of varying-motion gears of opposite phase, so that the space between said arms periodically change the volume included between them and the housing. In this embodiment the gears 27, 27′ on the offset shaft contain half the numbers of teeth on the gears 28, 28′. Ignition 30 is at the shown top, adjacent the minumum space between the arms shown at 23, 23′. After half a turn of the offset shaft 26, the arms 23, 23′ will be in the positions of arms 23′, 24, where they include a maximum space between each other. Expansion is completed. Exhaust starts through channel 31 and continues as the arms come together again. It ends when the arms are in positions 24, 24′ after a further half-turn of the offset shaft. Intake starts through channel 32. It is completed when the arms are in positions 24′, 23. Then compression starts. It ends in the arm position 23, 23′. Ignition occurs just before this position. And a new cycle starts after two full turns of the offset shaft 26.

Known sealing elements are preferably usd at the rotor arms, but are not shown at the small scale used.

Perfect mass-balance is attained by keeping the angular acceleration of one rotor equal to the angular deceleration of the other rotor at all times.

According to the invention the varying-ratio gears are made to enforce a relationship, whereby on uniform rotation of the offset counter-shaft each rotor has a uniform rotation plus a harmonic motion added to it. When $\theta$ denotes the turning angle of the offset shaft, the turning angle $\theta'$ of a rotor may be described by $\theta' = \frac{1}{2}\theta + c \sin \theta$; for tooth ratios of 1 : 2; and the angular velocity ratio by $$d\Theta'/d\Theta = \tfrac{1}{2} + c \cos \Theta$$

Similarly, when the two gears of a pair have equal tooth numbers, and an overall tooth ratio of 1 : 1, the turning angle $\theta'$ of a rotor can be expressed in terms of the turning angle $\theta$ of the offset shaft by $$\Theta' = \Theta + c \sin 2\Theta; \text{ and}$$

$$d\Theta'/d\Theta = 1 + 2c \cos 2\Theta$$

It will be shown now that the two gears even of a pair with equal tooth members have to differ from each other for full mass-balance. The gear motion is generally described by pitch lines or pitch curves that roll on each other without slippage and are rigid respectively with the two gears of a pair.

Figure 9:
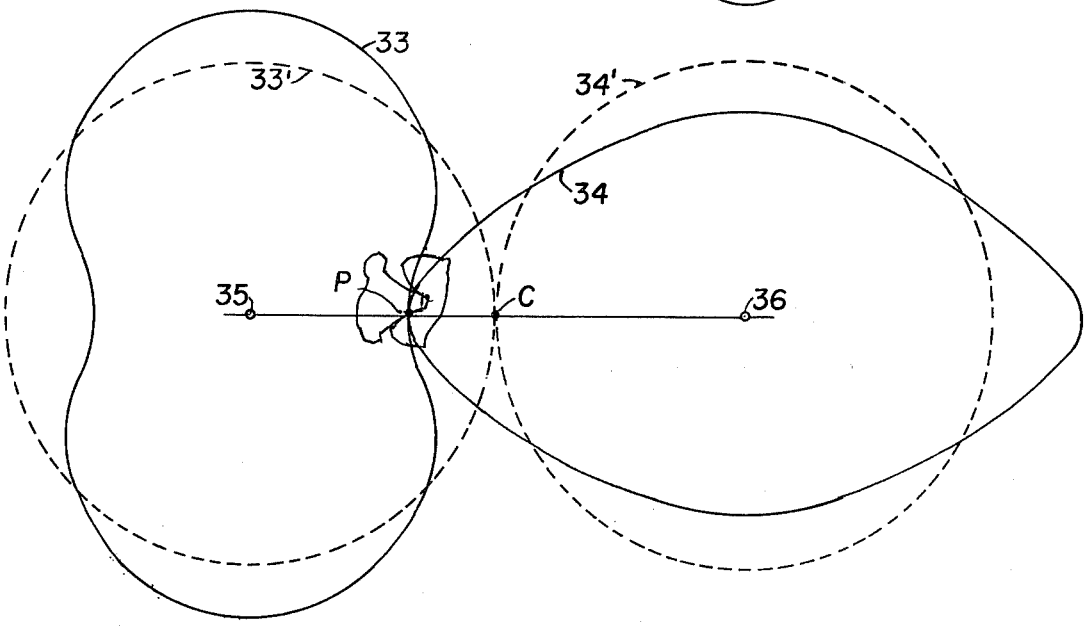
FIG. 9 shows the pitch lines of a pair of varying-motion gears used in the embodiment of FIG. 6.

FIG. 9 illustrates the pitch lines of a gear pair with equal tooth numbers. Pitch line 33 is on the gear rigid with the offset shaft that turns uniformly, while pitch line 34 is rigid with a rotor. 35, 36 are the centers of rotation. The two equal circles 33′, 34′ with radius R = ½(35–36) refer to pitch circles for constant-ratio gears, gears transmitting uniform motion. They contact at fixed point C. The pitch lines 33, 34 always contact each other on the line of centers 35, 36, at any instant at a point P that moves along the line of centers as the gears turn. The proportion 35-P to P-36 equal the instantaneous ratio $d\theta'/d\theta$. Let $e$ denote distance CP. It is negative in FIG. 9.

Ratio $d\theta'/d\theta = R + e/R - e = 1 + 2c \cos 2\theta$, shown above. $\theta$ is 90° in FIG. 9.

Hence $$e = \cdot R \cdot \frac{c \cos 2\Theta}{1 + c \cos 2\Theta}$$

At $2\theta = 0°$ and $180°$ $e/R$ is $c/1 + c$ and $-c/1 - c$ respectively.

A positive $e$ is an increase of the radial distance of point P from center 35 of the offset shaft, and a decrease of the distance from center 36 of the rotor. Pitch line 33 projects less outwardlly of circle 33′ than it recedes inwardly thereof. Pitch line 34 of the gear rigid with the rotor projects outwardly of circle 34′ more than it recedes inwardly thereof. It projects outwardly of the uniform-motion pitch circle more than pitch line 33. Also the shape of the two pitch lines 33, 34 is quite different, even when the tooth numbers are equal. Pitch line 33 contains concave portions, in the region of closest approach to center 35. Pitch line 34 is convex throughout. All these features are required characteristics for perfect mass-balance, that keep vibrations down and permit operation at high speed; and thereby favor small size.

Gears of this kind may be produced for instance with a reciprocating cutter of Fellows type, whose pitch circle is made to roll slowly on the curved pitch line of the varying-motion gear.

Generally however I prefer tooth ratios of 1 : 2 because they permit simpler accurate production. Besides a smaller flywheel (39, FIG. 1) is sufficient for the same stabilizing effect, because of the double angular speed.

Figure 7:
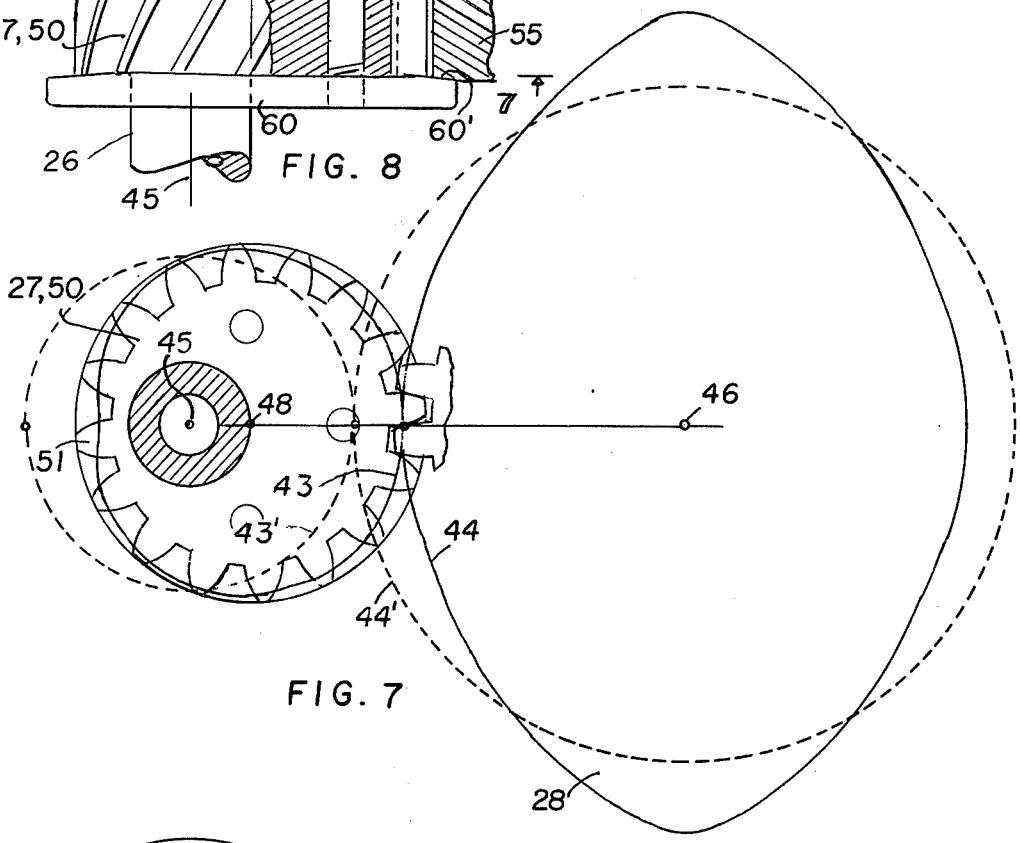
FIG. 7 shows the pitch lines of a pair of varying-motion gears used in the embodiment of FIGS. 1 to 3, showing also tooth profiles. The pitch lines roll on each other without slippage.

FIG. 7 shows a pitch line 43 of gear 27 rigid with the uniformly rotating offset shaft, and pitch line 44 of gear 28 rigid with a rotor. The circles 43′ and 44′ denote the pitch circles of uniform-motion gears of the same tooth numbers and center distance. $r$ is the radius of circle 43′, $2r$ the radius of circle 44′. $\theta$ is zero in FIG. 7. The instantaneous ratio $d\theta'/d\theta$ $$\frac{d\Theta'}{d\Theta} = \frac{r+e}{2r-e} = \tfrac{1}{2} + c\cos\Theta$$

$$e = r \cdot \frac{4c\cos\Theta}{3 + 2c\cos\Theta}$$

hence so that $e/r$ at $\theta = 0°$ and $180°$ amounts to $4c/3 + 2c$ and $-4c/3 - 2c$ respectively.

The second figure is numerically larger than the first one. Yet they result in perfectly balanced accelerations.

It is seen that pitch line 43 is close to a circle whose center 48 is offset from center 45. It thus becomes possible to use an eccentric gear 50 on shaft 26. The pitch line of no slippage then generally follows the teeth 51 that extend in a circle about center 48, but also extends somewhat depthwise of the tooth zone. The mating gear on the rotor is made exactly conjugate to gear 50 with center 48, so that the pitch lines 43, 44 remain as required and as shown.

The shaft 26 with opposite eccentric gears 50 is mass-balanced by oppositely set weights 49.

A procedure for cutting the gear on the rotor is diagrammatically shown in FIG. 10 for use of straight teeth. A Fellows-type reciprocatory cutter 53 is set eccentric of its axis 45 of angular feed, to represent gear 50′. It is reciprocated axially along axis 45 in engagement with gear 55 that contains pitch line 44. Along therewith it is angularly fed on axis 45, while gear 55 is angularly fed on its axis 46 in direct proportion to the turning motion on axis 45 and to an added harmonic motion. The added motion is attainable by moving the worm 56 axially. Worm 56 meshes with a wormgear 57 with which gear 55 is rigid. $R_w$ is the pitch radius of gear 57. The axial worm displacement is obtained with a shaft 58 that turns exactly like cutter 53 turns on axis 45, $\theta$ being it turning angle. Shaft 58 may carry an eccentric roller 59 that engages a plane-sided slot 60 of a slide movable in the direction of the worm axis, to move the worm axially. It provides the required harmonic motion of $R_w\, c \cos\theta$.

A procedure applicable also to helical teeth of gear 50 with pitch line 43 will be described later on.

Figure 8:
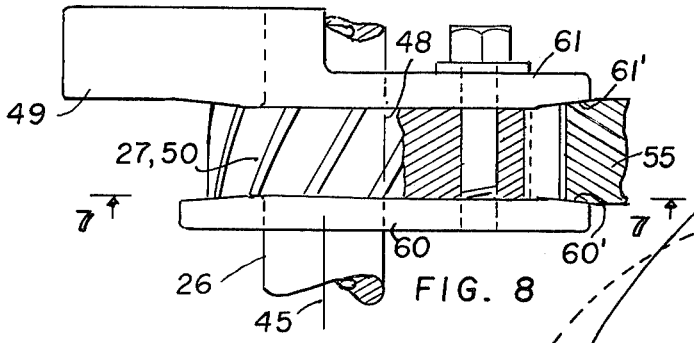
FIG. 8 is as view of gear 27 of FIG. 7, taken at right angles to its axis.

FIG. 8 shows a gear 50 rigid with the offset shaft 26, in a view taken at right angles to its axis. It contains helical teeth arranged about an axis 48 that is eccentric of the axis 45 of rotation. Disks 60 and 61 are rigidly secured to gear 50 on opposite sides thereof. Disk 61 is shaped to achieve also mass-balance of the offset shaft 26. The two disks contain slightly tapered working surfaces 60′, 61′ that bear against matching sides of the mating rotor gear 55, to take up the axial thrust of the helical teeth near the place where it originates. See also of FIG. 1.

Offset shaft 26 is made up of two parts rigidly secured together by a toothed face coupling 62. It is kept in tight engagement by a central screw whose head is visible at 59. For convenience a solid shaft 26 is shown in cross-section, in view of the small scale of the drawings. Also a rigid single shaft without face coupling may be used when the gears 50, 55 contain straight teeth parallel to the shaft axis.

The rotor arms or projecting blades (23, 23′) shown in FIG. 1 contain tapered or conical sides 63, so that they become narrower with increasing distance from the rotor axis, to provide a wide and strong base. The two rotors are rotatably mounted on a central rod 64 that is free to turn. Offset shaft 26 contains a fly-wheel 39 that may be connected to the outside through a releasable clutch.

Housing 25 contains cooling fins 70 at least in the region adjacent ignition and expansion. Liquid cooling may be provided if required.

Figure 4:
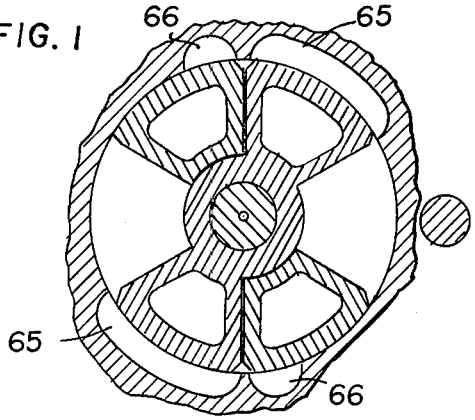
FIG. 4 is a fragmentary cross-section generally similar to FIG. 2 of a unit embodied as a compressor for air of gases.
Figure 5:
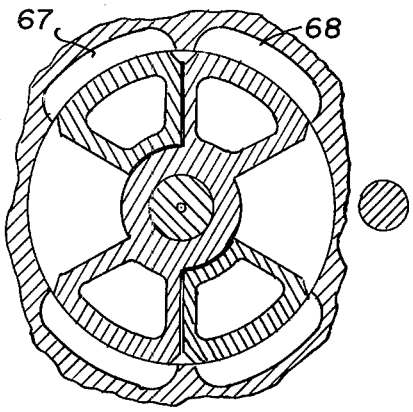
FIG. 5 is a similar cross-section of a pump for liquids, taken at right angles to the axes of the rotors and the counter-shaft.

FIGS. 4 and 5 are diagrammatic sections perpendicular to the rotor axis of a compressor and of a pump for liquids respectively. The intake channels 65 and the outlet channels 66 of FIG. 4 are shown for clockwise rotation of the rotors. In FIG. 5 67, 68 are the intake and outlet channels. In both cases there are two diametrically opposite intake channels, and two diametrically opposite outlet channels.

Figure 6:
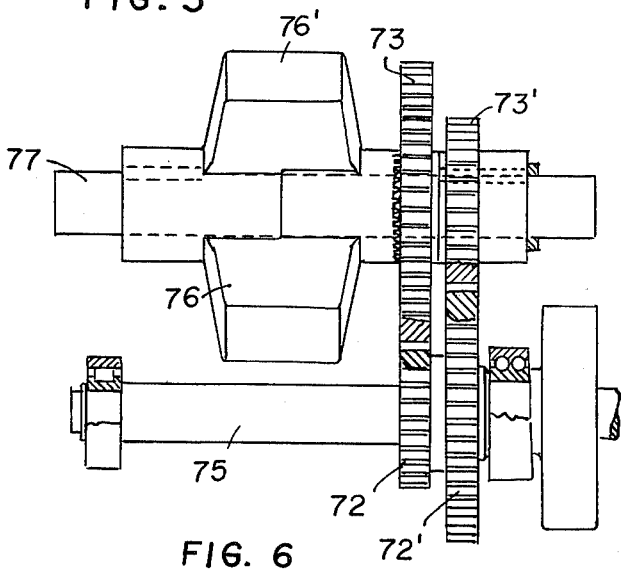
FIG. 6 is a section laid through the rotor axis and the axis of the offset counter-shaft of an engine, wherein the two gears of each pair of varying-motion gears have equal numbers of teeth.

FIG. 6 illustrates a disposition with varying-motion gear pairs of equal tooth numbers on both gears. It shows the movable parts only. The two gear pairs 72, 73 and 72′, 73′ are here shown at the same end of the unit. Gears 72, 72′ are secured to the offset counter shaft 75, while the gears 73, 73′ mating therewith are rigid with the two coaxial rotors 76, 76′ respectively. Gear 73′ is secured to a central shaft 77, that extends inside of the rotor hubs. Except for the different tooth ratio the operation of the unit is the same as described with FIGS. 1 and 2.

The machine set-up outlined in FIGS. 11 and 12 is for tooth ratios of 1:2. The gear 27 or 50 on the offset shaft may contain helical teeth, and is not confined to straight teeth. The cutter 80 with axis 81, embodying gear 27 or 50 is here not set eccentric of its axis of rotation; but the lack of eccentricity is made up by a circular translation imparted to the workpiece 55. Instead of the cutter center moving like center 48 (FIG. 7) about axis 45, the same relative circular translation is attained by displacing the workpiece axis 82 in a circular arc 83 centered at 84 without additional turning motion. It should be noted that at any equal phase position 48' and 82' the connecting line 81–82' of FIG. 11 has the same distance and the same inclination as the connecting line 48'–46 of FIG. 10.

The workpiece axis 82 describes a complete circle per turn of the cutter 80. The workpiece is secured to a wormgear 90 that is engaged by a worm 91. Wormgear 90 rests on a slide 92 that is movable towards and away from the cutter 80. Said slide contains an elongated slot for the shaft projection with axis 82 to pass through. Worm 91 is rotatably mounted on slide 92.

Another wormgear 93 provides said circular translation. It is rotatable on a cylindrical projection 84' with axis 84, secured to a base slide 95, and is engaged by a worm 96 rotatably mounted on said base slide. Projection 82 is adjustable on wormgear 93 to change its eccentricity, 82–84.

The worm drives 91, 90 and 96, 93 may be identical and have the same ratio, but worm 91 is then geared to half the angular speed of worm 96. Wormgear 93 is fed to turn exactly like cutter 80.

Like slide 92, whose sides rest on base slide 95, the latter is movable parallel to the axis of worm 96 and at right angles to the direction of the axis of worm 91. Slide 95 is used to feed to full cutting depth, at the start of the process. It is also used to accommodate jobs of different size. After full depth is reached slide 92 moves back and forth during cutting, on the now still base slide 95.

While it is possible to rotatably mount worm 91 in an axially fixed position on slide 92, the pitch diameter of wormgear 90 would have to be so fixed that the rolling motion of wormgear 90 on worm 91 in the circular translation is sufficient to produce the required harmonic turning displacement of wormgear 90. This would remain a single-purpose set-up.

For general use a harmonic axial displacement of worm 91 is required with respect to the upper slide 92. The harmonic displacement needed is the difference between the total harmonic displacement needed, less the displacement provided by the circular translation used. If $e_o$ denotes the radius of said translation, and $R_w$ the pitch radius of wormgear 90, the axial harmonic motion of the worm 91 should be $$(R_w \cdot c - e_o) \cdot \cos \theta$$

This motion may be derived from the circular translation of the workpiece. A bar 97 has a bore surrounding the shaft projection 82. It is movable laterally in a guideway on slide 92. At its opposite end bar 97 is pivotally connected at 98 to a swinging arm 99. It is shown in its means position in FIG. 11 and in an angular position in FIG. 11*a*. Its center line passes through the pivotal axis 100 of a guide 101 carried by slide 92. The plane sides of said guide slidably engage arm 99. Aligned with the axis of worm 91 is the pivotal axis 102 of another similar guide 103, so that the central line of arm 99 passes through the axes 98, 100, 102. Guide 101 is laterally adjustable along line 104 to change the axial displacement of the worm 91. This displacement is in direct proportion to the harmonic displacement of bar 97.

While several applications of the invention have been specifically referred to, the invention applies also to further embodiments, and should be interpreted with the recital of the appended claims.

I claim:

1. A rotary positive displacement unit having two coaxial rotors whose arms project outwardly from their axis inside of a housing, a shaft offset from the rotor axis for transmission of motion between said rotors and the outside, a pair of varying-motion gears between said shaft and one of said rotors, another pair of varying-motion gears of opposite phase connecting said shaft with the other rotor, to achieve spaces of varying volume between said arms, wherein the gear on the rotor of each of said pairs has twice as many teeth as the mating gear on said offset shaft, said mating gear has beeth arranged in a circle eccentric of its axis of rotation while its pitch lines, that roll on the mate without slippage, have a varying distance from said circle.

2. A rotary displacement unit according to claim 1, wherein said mating gear contains equal helical teeth all around its periphery.

3. A rotary displacement unit according to claim 1, wherein said mating gear has straight teeth parallel to its axis, said teeth being all alike around its periphery.

4. A unit according to claim 2 wherein said mating gear is a helical pinion that contains disks secured to opposite sides of its face, said disks having tapered surfaces bearing against opposite side faces of the mating gear, to balance the axial thrust of the helical teeth directly.

5. A rotary positive-displacement unit having two coaxial rotors whose arms project outwardly from their axis inside of a housing, a uniformly rotating shaft offset from the rotor axis for transmission of motion between said rotors and the outside, a single pair of varying-motion gears directly connecting said shaft with one of the rotors, another single pair of varying-motion gears of opposite phase directly connecting said shaft with the other rotor, to achieve strokes with spaces of varying volume between said arms, each of said pairs comprising a pinion rigid with said offset shaft and a gear rigid with a rotor, said gear having twice as many teeth as said pinion, their pitch lines that roll on each other without slippage being symmetrical with respect to a plane containing the axis of rotation, which plane coincides with the plane that contains the axes of the gear pair in the turning positions of minimum and maximum reduction ratio, and the diameter of the pinion pitch lines in said axial plane of minimum reduction ratio being smaller than their diameter at right angles thereto.

6. A unit according to claim 5, wherein the varying-motion gears rigid with the uniformly rotating shaft offset from the rotor axis contain pitch lines that have a nearly straight portion at the region of closest approach to their axis of rotation, while the pitch-lines of the mating gears are convex throughout, said pitch lines roll on each other without slippage.

7. A rotary positive-displacement unit according to claim 5, having spaces changing between a minimum and a maximum volume twice per revolution of the rotors, wherein the unit is embodied as an internalcombustion engine, containing means to effect ignition at one of the two spaces of minimum volume.

8. A rotary positive-displacement unit according to claim 5, having spaces changing between a minimum and a maximum volume twice per revolution of the rotors, wherein the unit is embodied as a compressor, a pair of channels for conducting the compressed fluid being placed adjacent both minimum volumes, said channels starting after said space-volume has been reduced.

9. A unit according to claim 5, wherein the varying-motion gear pair is designed to provide a turning angle of the rotor proportional to the turning angle of said offset shaft plus an added turning angle proportional to the sine function thereof.

10. The unit according to claim 9, wherein the varying-motion gear rigid with a rotor has double the number of teeth of its mate, and wherein said sine function is for the turning angle ($\theta$) of said offset shaft, being proportional to sin $\theta$, the pitch line of said mate having a nearly straight portion nearest to its axis of rotation.

* * * * *